US005497522A

United States Patent [19]

Chen

[11] Patent Number: 5,497,522

[45] Date of Patent: Mar. 12, 1996

[54] COMBINATION TOOL

[76] Inventor: Chin-Chuan Chen, 7F, No. 13, Lane 364, Sec. 1, Kee Lung Rd., Taipei, Taiwan

[21] Appl. No.: 284,825

[22] Filed: Aug. 2, 1994

[51] Int. Cl.[6] ..... B25B 7/22

[52] U.S. Cl. ..... 7/128; 7/107; 30/257; 81/418

[58] Field of Search ..... 7/107, 125–135, 7/157, 158; 81/418; 30/229, 257

[56] References Cited

U.S. PATENT DOCUMENTS

| | | | |
|---|---|---|---|
| 3,760,473 | 9/1973 | Studdard | 7/125 X |
| 3,947,905 | 4/1976 | Neff | 7/131 X |
| 4,942,637 | 7/1990 | Yeang-Yai | 7/135 |
| 5,074,046 | 12/1991 | Kolesky | 30/257 X |
| 5,157,996 | 10/1992 | Keyvani | 30/257 X |

*Primary Examiner*—James G. Smith
*Attorney, Agent, or Firm*—Bucknam and Archer

[57] ABSTRACT

A combination tool including a first blade and a second blade pivoted in the middle by a pivot, the first and second blades having a respective long nose at one end worked against each other and a respective handle at an opposite end, wherein a rasp is longitudinally integrally made on the long nose of the first blade at an outer side; a file is longitudinally integrally made on the long nose of the second blade at an outer side; two teethed notches are respectively made on the first and second blades and worked together as a socket wrench; a can opener is integrally made on the second blade adjacent to the pivot at the front; a corkscrew is fixedly fastened to the second blade between the pivot and the corresponding handle for drawing corks from bottles; a wire hole is made on the first blade for pulling wires.

4 Claims, 2 Drawing Sheets

COMBINATION TOOL

BACKGROUND OF THE INVENTION

The present invention relates to hand tools, and relates more particularly to a combination tool for multiple purposes.

A variety of hand tools are known and intensively used for different purposes. As regular hand tools are designed for a respective purpose, one may have to prepare various hand tools for different purposes. There is a commercially available multipurpose tool having crimpers, wire cutters and wire strippers for crimping, cutting and stripping electric wires. However, the limited functions of this structure of multipurpose tool still cannot satisfy the demand for multiple functions.

SUMMARY OF THE INVENTION

The present invention has been accomplished under the circumstances in view. It is therefore the principal object of the present invention to provide a combination tool which provides a variety of functions. It is another object of the present invention to provide a combination tool which is compact. According to the preferred embodiment of the present invention, the combination tool comprises a first blade and a second blade pivoted in the middle by a pivot, the first and second blades having a respective long nose at one end worked against each other and a respective handle at an opposite end, wherein a rasp is longitudinally integrally made on the long nose of the first blade at an outer side; a file is longitudinally integrally made on the long nose of the second blade at an outer side; two teethed notches are respectively made on the first and second blades and worked together as a socket wrench; a can opener is integrally made on the second blade adjacent to the pivot at the front; a corkscrew is fixedly fastened to the second blade between the pivot and the corresponding handle for drawing corks from bottles; a wire hole is made on the first blade for pulling wires; two longitudinal storage chambers are respectively made on the first and second blades for keeping accessories; a plurality of folding blades are respectively pivoted to the handles of the first and second blades.

DETAILED DESCRIPTION OF THE PREFERRED EMBODIMENT

Figure 1:
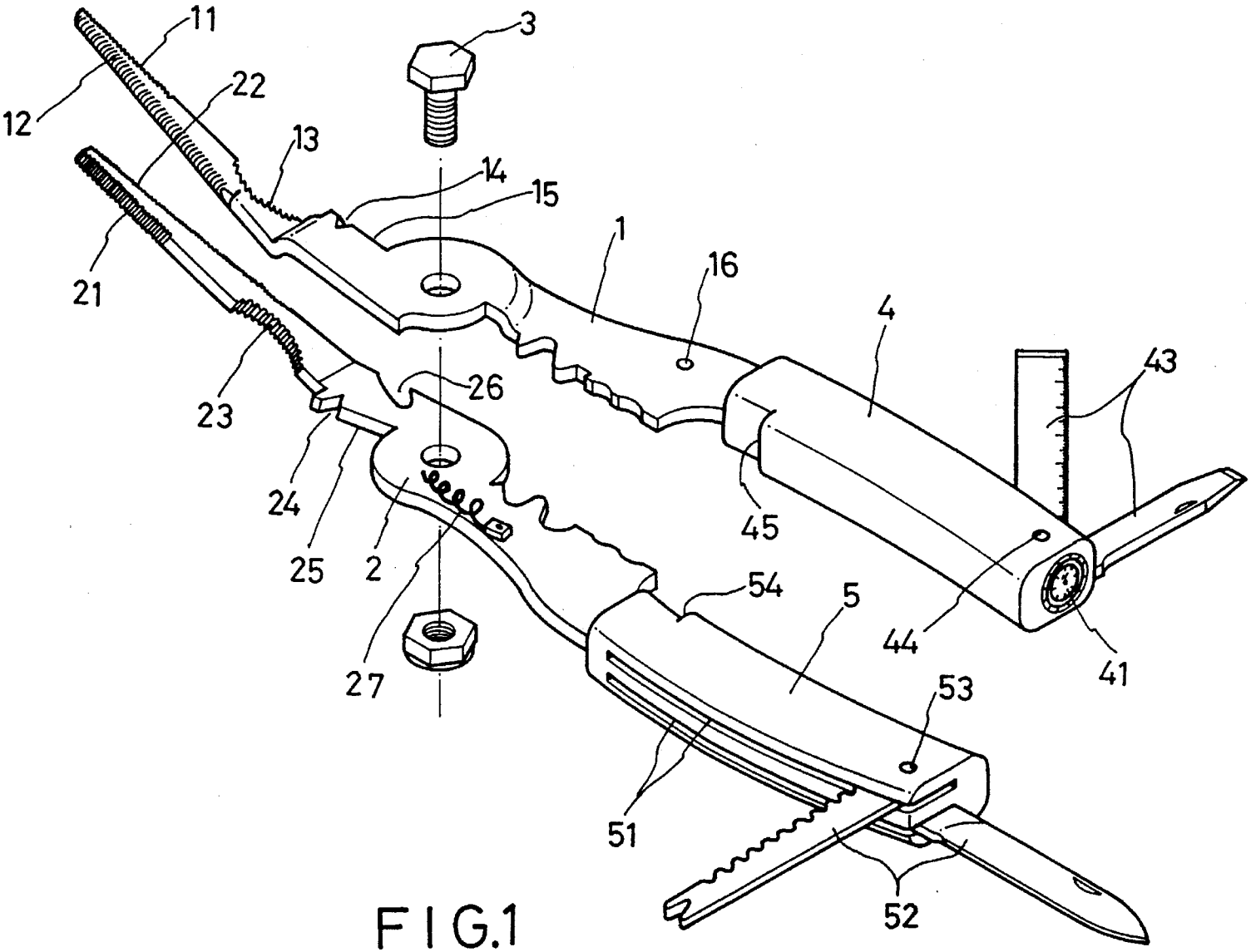
FIG. 1 is an elevational view of a combination tool according to the preferred embodiment of the present invention.
Figure 2:
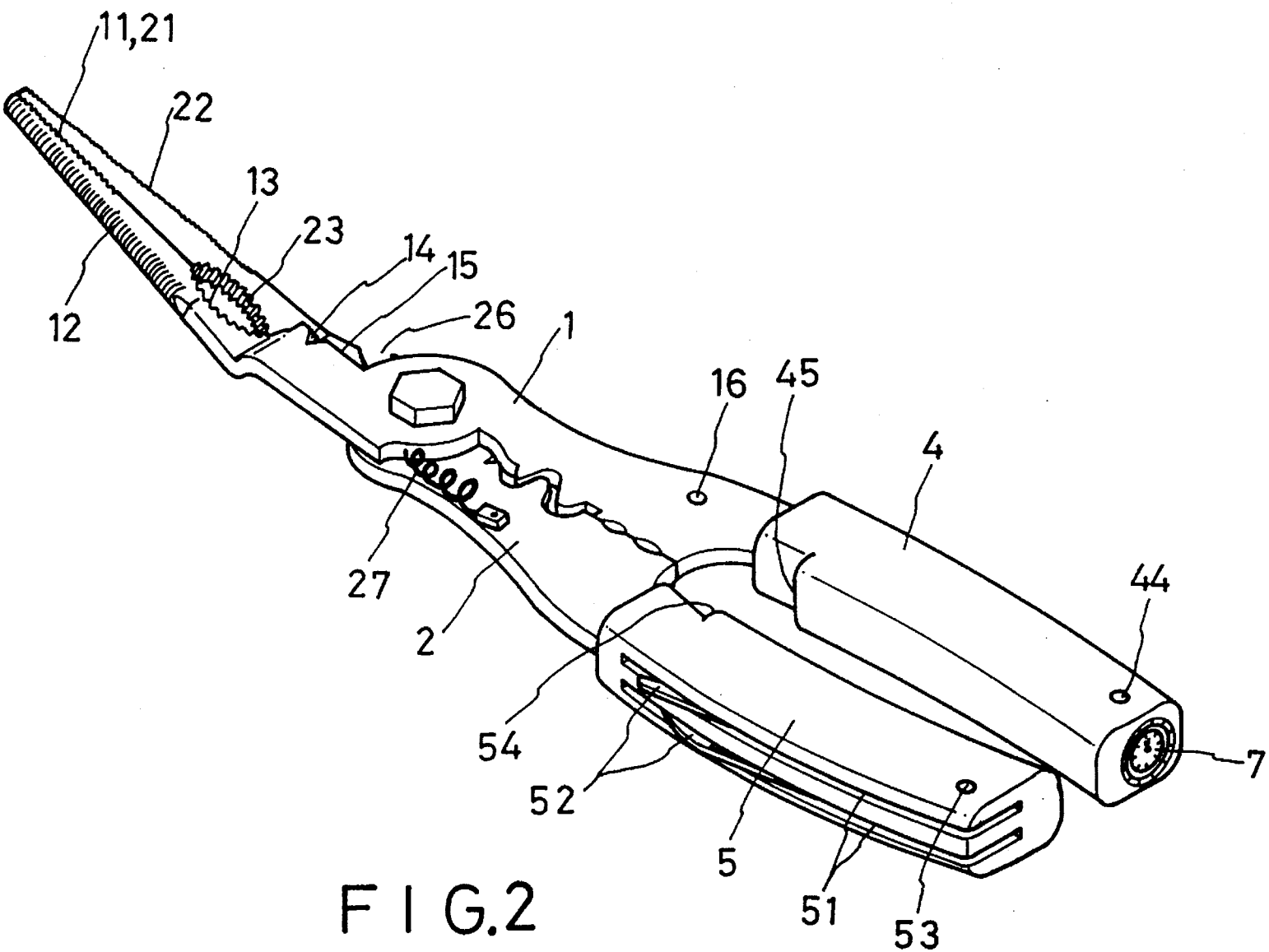
FIG. 2 is an exploded view of the combination tool shown in FIG. 1.

Referring to FIGS. 1 and 2, a combination tool in accordance with the present invention is generally comprised of a first blade 1, a second blade 2, a pivot 3, a first handle 4, and a second handle 5.

The first and second blades 1 and 2 are respectively made from high carbon steel and pivoted together by the pivot 3. The front ends of the first and second blades 1 and 2 terminate in a pair of elongated, toothed jaw plates 11 and 21 forming a pair of long nose pliers. The rear ends of the first and second blades 1 and 2 are respectively connected to the first and second handles 4 and 5. The toothed jaw plate 11 of the first blade 1 has points 12 at an outer side (relative to the toothed jaw plate 21 of the second blade 2), and therefore the toothed jaw plate 11 of the first blade 1 can be served as a rasp. The toothed jaw plate 21 of the second blade 2 has ridges 22 at an outer side (relative to the toothed jaw plate 11 of the first blade 1), and therefore the toothed jaw plate 21 of the second blade 2 can be served as a file. The first and second jaw plates 11 and 21 further have a respective toothed notch 13 or 23 matching each other to serve as a box wrench, a respective V-cut 14 or 24 matching each other to serve as a wire stripper, and a respective cutting edge 15 or 25 matching each other to serve as a wire cutter. The second blade 2 further comprises a unitary can opener 26. The first and second blades 1 and 2 further have a respective serrated portions at an inner side between the pivot 3 and the respective handle 4 or 5 such that the serrated portions can be operated to serve as a wire crimper. The first blade 1 further comprises a circular wire hole 16 for pulling wires. A corkscrew 27 is made on the second blade 2 adjacent to the serrated portion of the second blade 2.

The first handle 4 is molded from insulative material, comprising a compass 41 mounted on the rear end, a plurality of longitudinal slots (not shown) at an outer side, a pivot 44 through the longitudinal slots, and tools (rules, cutters, screwdrivers, etc.) 43 turned about the pivot 44 and received in the longitudinal slots.

The second handle 5 is molded from insulative material, comprising a plurality of longitudinal slots 51 at an outer side, a pivot 53 through the longitudinal slots 51, and tools (wood saws, spear blades, etc.) 52 turned about the pivot 53 and received in the longitudinal slots 51 respectively.

The first and second handles 4 and 5 further comprises a respective storage chamber 45 or 54 longitudinally disposed at an inner side for keeping small accessories such as toothpicks, bits, tweezers, etc.

Referring to FIG. 2 again, when the combination tool is assembled, it can be used for a variety of purposes. In addition to the functions of crimping and cutting wires, the toothed jaw plate 11 can be used as a rasp, the toothed jaw plate 21 can be used as a file, the toothed notches 13 and 23 can be worked together to serve as a box wrench, the corkscrew 27 can be used to draw corks from bottles.

What is claimed is:

1. A combination tool comprising a first blade and a second blade, each blade having a midpoint where the blades are pivoted by a pivot, said first and second blades having a respective long nose at one end adapted for cooperating counteraction against each other and a respective handle at an opposite end, the improvement comprising a rasp longitudinally integrally made on the long nose of said first blade at an outer side, a file longitudinally integrally made on the long nose of said second blade at an outer side, two toothed notches respectively made on said first and second blades and worked together as a socket wrench, a can opener integrally made on said second blade adjacent to said pivot at the front, a corkscrew fixedly fastened to said second blade between said pivot and the handle on said second blade, and a wire hole on said first blade for pulling wires.

2. The combination tool of claim 1 wherein the handles of said first and second blades are respectively molded from insulative material, having each a plurality of longitudinal slots at an outer side and a plurality of folding hand tools pivotally received in the respective longitudinal slots.

3. The combination tool of claim 1 wherein the handle of said first blade has a compass at the end.

4. The combination tool of claim 1 wherein the handles of said first and second blades have a respective longitudinal storage chamber for keeping accessories.

* * * * *